US011053666B2

(12) United States Patent
Fiser et al.

(10) Patent No.: US 11,053,666 B2
(45) Date of Patent: Jul. 6, 2021

(54) CYLINDER IN BOOM

(71) Applicant: Clark Equipment Company, West Fargo, ND (US)

(72) Inventors: Jaroslav Fiser, Pribram (CZ); Martin Masa, Dobris (CZ); Bohuslav Vasicek, Prague (CZ)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 69 days.

(21) Appl. No.: 16/489,898

(22) PCT Filed: Mar. 23, 2018

(86) PCT No.: PCT/US2018/023977

§ 371 (c)(1),
(2) Date: Aug. 29, 2019

(87) PCT Pub. No.: WO2018/175858

PCT Pub. Date: Sep. 27, 2018

(65) Prior Publication Data

US 2020/0024829 A1 Jan. 23, 2020

Related U.S. Application Data

(60) Provisional application No. 62/475,454, filed on Mar. 23, 2017.

(51) Int. Cl.

| | |
|---|---|
| ***E02F 9/22*** | (2006.01) |
| ***E02F 3/32*** | (2006.01) |
| ***E02F 3/42*** | (2006.01) |

(52) U.S. Cl.

CPC ..... *E02F 9/2271* (2013.01); *E02F 3/32* (2013.01); *E02F 3/425* (2013.01); *E02F 9/2267* (2013.01)

(58) Field of Classification Search

CPC ... E02F 3/32; E02F 3/325; E02F 3/388; E02F 3/425; E02F 9/2267; E02F 9/2271

USPC ..... 414/687

See application file for complete search history.

(56) References Cited

U.S. PATENT DOCUMENTS

| | | | |
|---|---|---|---|
| 3,042,233 | A | 7/1962 | Wills |
| 3,057,494 | A | 10/1962 | Holopainen et al. |
| 3,081,891 | A | 3/1963 | Przybylski |
| 3,140,785 | A | 7/1964 | Pilch |
| 3,148,788 | A | 9/1964 | Ferwerda |
| 3,243,065 | A | 3/1966 | Moore |

(Continued)

FOREIGN PATENT DOCUMENTS

| | | | | |
|---|---|---|---|---|
| EP | 1482096 | A2 | 12/2004 | |
| JP | 09013419 | A * | 1/1997 | ..... E02F 9/2271 |

OTHER PUBLICATIONS

International Search Report and Written Opinion dated Jun. 7, 2018 for International Application No. PCT/US2018/023977 filed Mar. 23, 2018, 12 pages.

*Primary Examiner* — Saul Rodriguez
*Assistant Examiner* — Brendan P Tighe
(74) *Attorney, Agent, or Firm* — John Veldhuis-Kroeze; Westman, Champlin & Koehler, P.A.

(57) ABSTRACT

Excavator having a stop positioned on a boom to protect a boom actuator from damage due to impact with an implement such as a blade, impact with handled material, or impact with other debris or objects. Boom actuators include an override device to allow the boom to be lowered in the event of an accident or component failure.

14 Claims, 8 Drawing Sheets

(56) References Cited

U.S. PATENT DOCUMENTS

| | | | | | |
|---|---|---|---|---|---|
| 3,273,729 | A | | 9/1966 | Holopainen | |
| 3,339,763 | A | | 9/1967 | Caywood et al. | |
| 3,390,794 | A | | 7/1968 | McMullen et al. | |
| 3,515,298 | A | | 6/1970 | Guinot | |
| 3,554,395 | A | | 1/1971 | Dunbar | |
| 3,653,131 | A | | 4/1972 | Pilch | |
| 3,840,132 | A | | 10/1974 | Howells, Jr. et al. | |
| 3,966,065 | A | | 6/1976 | Jones | |
| 4,074,821 | A | | 2/1978 | Long | |
| 4,212,582 | A | | 7/1980 | Stecklein | |
| 4,552,503 | A | | 11/1985 | Mouri et al. | |
| 4,686,782 | A | | 8/1987 | Nagatomo | |
| 4,966,240 | A | * | 10/1990 | Aikawa | E02F 9/2004 172/825 |
| 2009/0229678 | A1 | | 9/2009 | Dosedel | |

* cited by examiner

CYLINDER IN BOOM

CROSS-REFERENCE TO RELATED APPLICATION

This Application is a Section 371 National Stage Application of International Application No. PCT/US2018/023977, filed Mar. 23, 2018 and published as WO 2018/175858 A1 on Sep. 27, 2018, in English, which claims priority to U.S. Provisional Application No. 62/475,454 filed Mar. 23, 2017, the contents of which are hereby incorporated by reference in their entirety.

BACKGROUND

This disclosure is directed toward power machines. More particularly, this disclosure is directed to power machines, such as excavators, with a lift arm including a boom.

Power machines, for the purposes of this disclosure, include any type of machine that generates power for the purpose of accomplishing a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include excavators, loaders, utility vehicles, tractors, and trenchers, to name a few examples.

In excavators and work vehicles having a lift arm, a hydraulic cylinder actuator (a "boom cylinder") which raises and lowers the boom portion of the lift arm can be damaged by impact with handled material, debris, falling objects, or collision with the machine's other structures. For example, in excavators and some other work vehicles, a separate blade implement is provided in addition to the lift arm. Contact between the blade and the boom cylinder can damage the lift cylinder.

The discussion above is merely provided for general background information and is not intended to be used as an aid in determining the scope of the claimed subject matter.

SUMMARY

Disclosed are excavators and power machines. In one embodiment, a power machine includes a frame with a lower portion and an upper frame portion. The upper frame portion is rotatably mounted on the lower frame portion and configured to be rotated relative to the lower frame portion. A first lift arm structure having a boom is pivotably coupled to the upper frame portion at a first pivot joint. A boom actuator is pivotally coupled between the boom and the upper frame portion at a second pivot joint. The boom actuator is pivotally coupled between the boom and the upper frame portion at a second pivot joint and operable to raise and lower the boom relative to the upper frame portion.

A second lift arm is pivotably coupled to the lower frame portion and having a lower lift arm. A lower lift arm actuator is coupled between the lower lift arm and the lower frame portion and is operable to raise and lower the lower lift arm relative to the lower frame portion. An implement is mounted to the second lift arm and configured to be raised and lowered with the second lift arm by the lower lift arm actuator. A surface of the implement moves along a second path as the lower lift arm is raised and lowered by the lower lift arm actuator. The first path of the boom and the second path of the surface of the implement intersect. A stop is positioned and oriented to receive contact between the boom and the surface of the implement as the boom moves along the first path and the surface of the implement moves along the second path to prevent contact between the boom actuator and the implement.

This Summary and the Abstract are provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Disclosed embodiments include boom cylinder protection concepts in which a boom or lift arm includes a stop portion configured and positioned to prevent damage to the boom or lift cylinder by preventing collision of the boom cylinder with a lower implement such as a dozer blade or by preventing impact between the boom cylinder and handled material, debris, falling objects, etc. Also, in some embodiments, the boom cylinder includes an override device configured to allow the boom to be lowered in the event of an accident such as a burst hydraulic hose.

Figure 2:
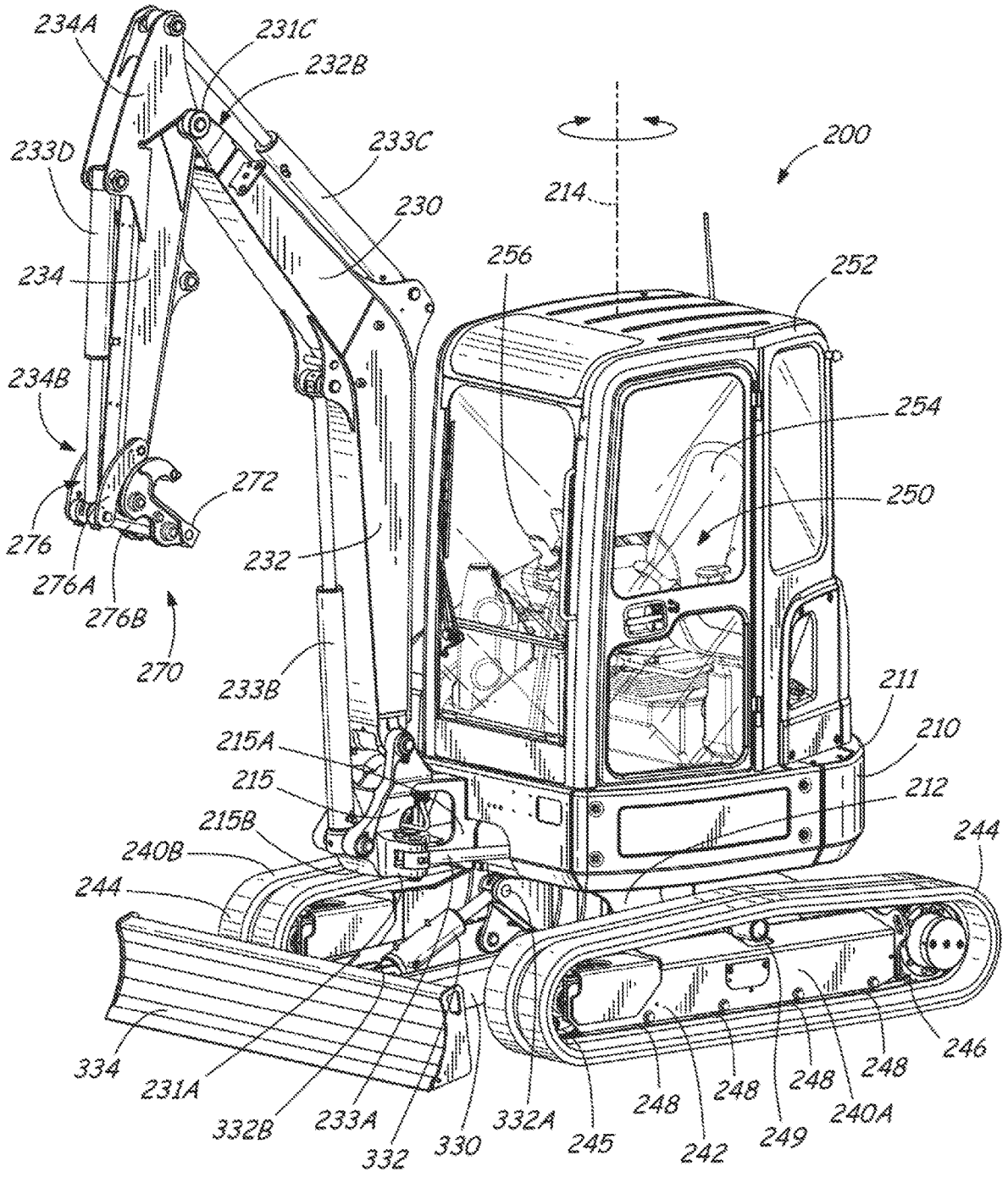
FIG. 2 is a front left perspective view of a representative power machine in the form of an excavator on which the disclosed embodiments can be practiced.
Figure 3:
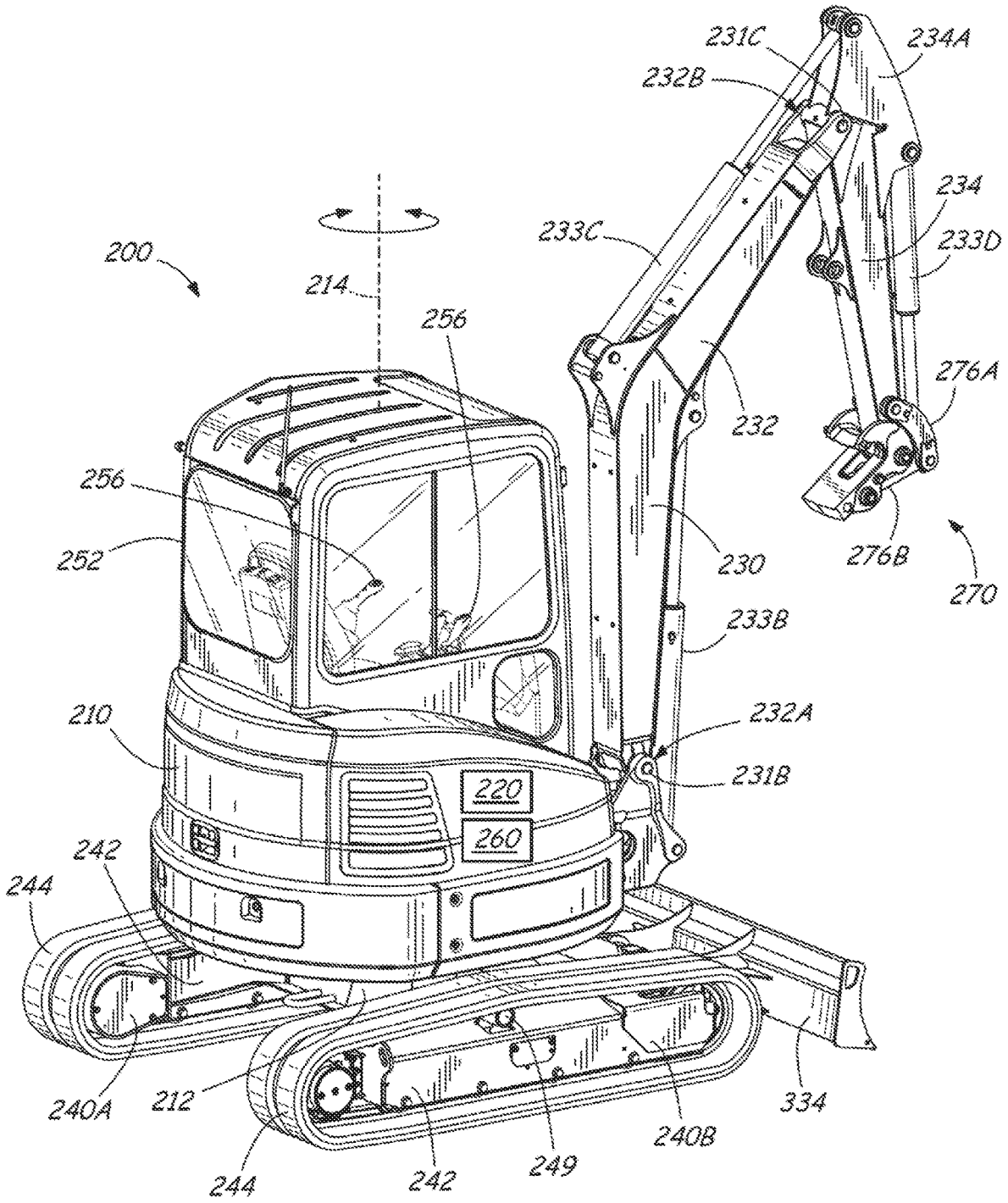
FIG. 3 is a rear right perspective view of the excavator of FIG. 2.
Figure 4:
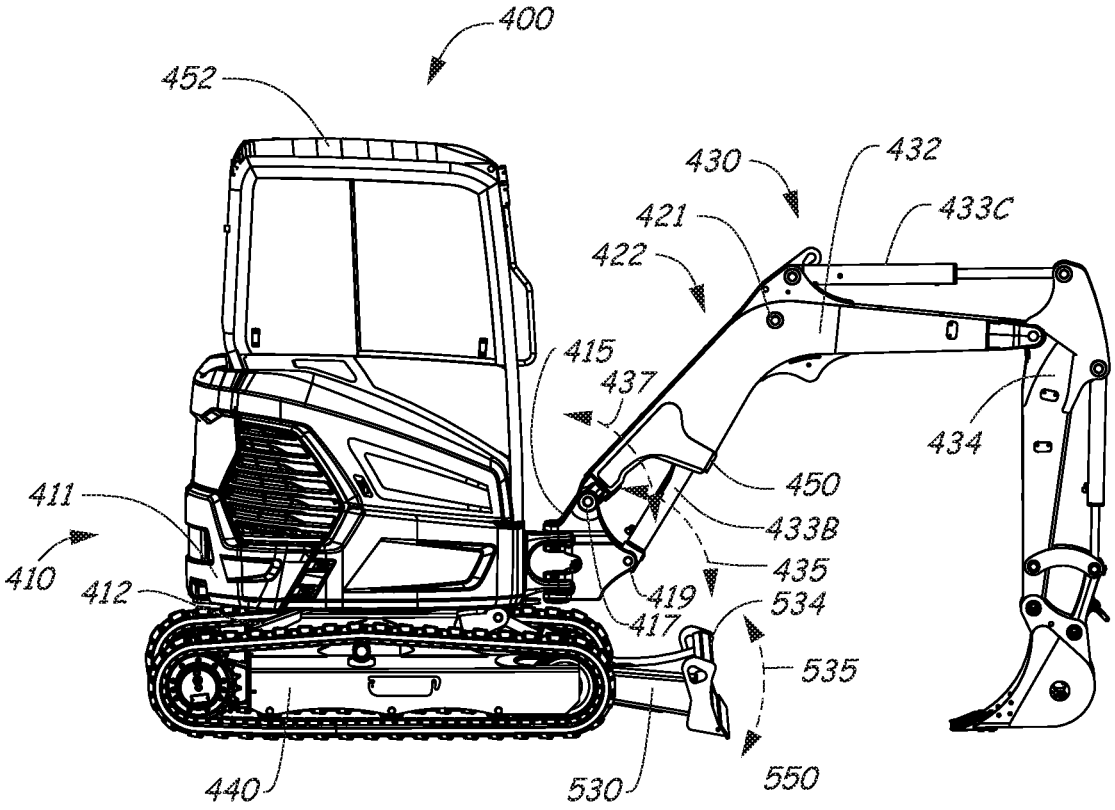
FIG. 4 is a side view illustration of another representative power machine in the form of an excavator in which the disclosed embodiments can be practiced.

These concepts can be practiced on various power machines, as will be described below. A representative power machine on which the embodiments can be practiced is illustrated in diagram form in FIG. 1 and examples of such a power machine are illustrated in FIGS. 2-4 and described below before any embodiments are disclosed. For the sake of brevity, only a few power machines are discussed. However, as mentioned above, the embodiments below can be practiced on any of a number of power machines, including power machines of different types from the representative power machine shown in FIGS. 2-4. Power machines, for the purposes of this discussion, include a frame, at least one work element, and a power source that is capable of providing power to the work element to accomplish a work task. One type of power machine is a self-propelled work vehicle. Self-propelled work vehicles are a class of power machines that include a frame, work element, and a power source that is capable of providing power to the work element. At least one of the work elements is a motive system for moving the power machine under power.

Figure 1:
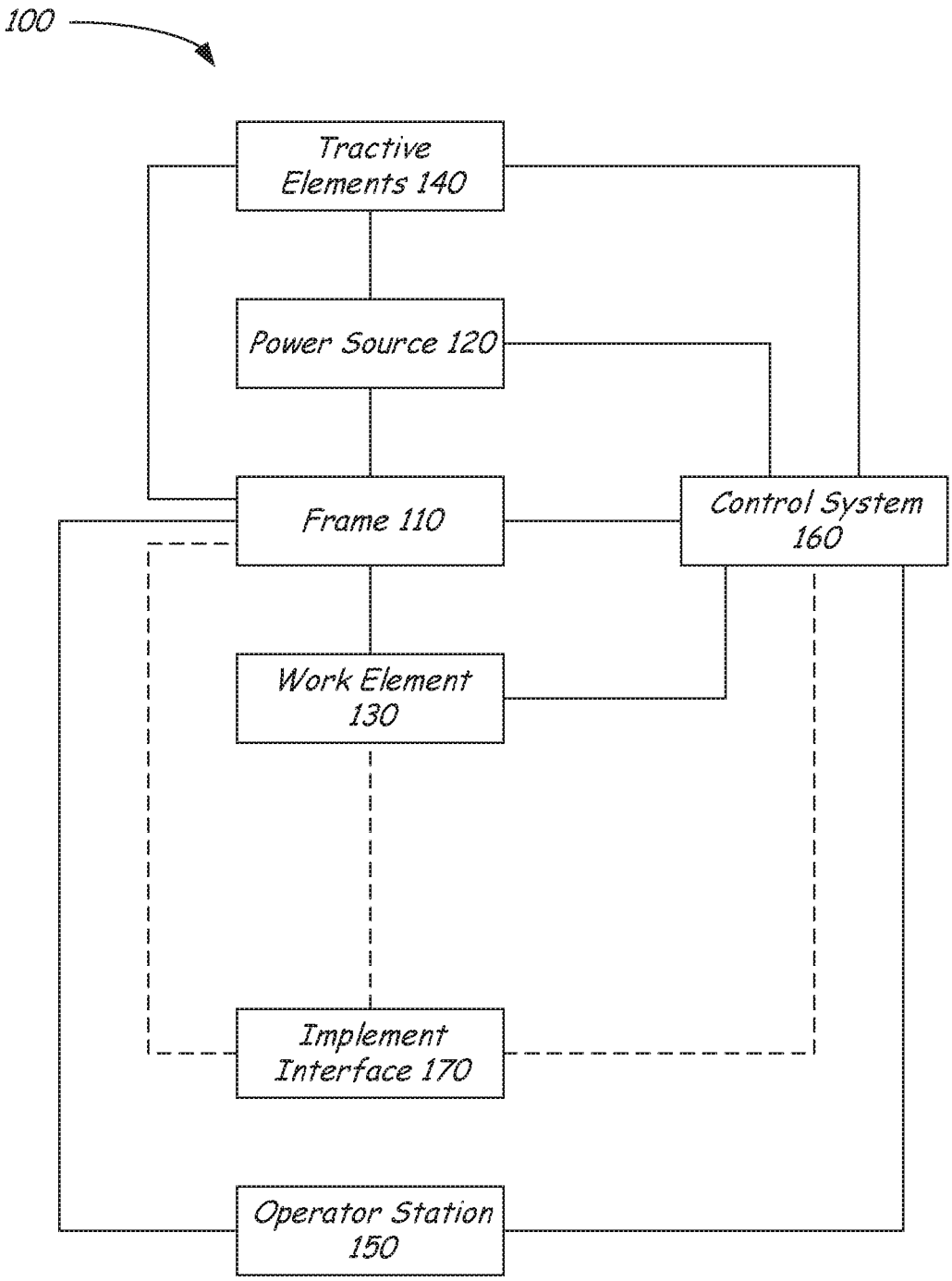
FIG. 1 is a block diagram illustrating functional systems of a representative power machine on which embodiments of the present disclosure can be practiced.

Referring now to FIG. 1, a block diagram illustrates the basic systems of a power machine 100 upon which the embodiments discussed below can be advantageously incorporated and can be any of a number of different types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that are capable of performing a dedicated task. For example, some work vehicles have a lift arm to which an implement such as a bucket is attached such as by a pinning arrangement. The work element, i.e., the lift arm can be manipulated to position the implement for the purpose of performing the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that is capable of moving with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is capable of providing power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is capable of converting the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, wheels attached to an axle, track assemblies, and the like. Tractive elements can be rigidly mounted to the frame such that movement of the tractive element is limited to rotation about an axle or steerably mounted to the frame to accomplish steering by pivoting the tractive element with respect to the frame.

Power machine 100 includes an operator station 150, which provides a position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e. from a remotely located operator station) instead of or in addition to an operator station adjacent or on the power machine. This can include applications where at least some of the operator controlled functions of the power machine can be operated from an operating position associated with an implement that is coupled to the power machine. Alternatively, with some power machines, a remote control device can be provided (i.e. remote from both of the power machine and any implement to which is it coupled) that is capable of controlling at least some of the operator controlled functions on the power machine.

FIGS. 2-3 illustrate an excavator 200, which is one particular example of a power machine of the type illustrated in FIG. 1, on which the disclosed embodiments can be employed. Unless specifically noted otherwise, embodiments disclosed below can be practiced on a variety of power machines, with the excavator 200 being only one of those power machines. Excavator 200 is described below for illustrative purposes. Not every excavator or power machine on which the illustrative embodiments can be practiced need have all of the features or be limited to the features that excavator 200 has. Excavator 200 has a frame 210 that supports and encloses a power system 220 (represented in FIGS. 2-3 as a block, as the actual power system is enclosed within the frame 210). The power system 220 includes an engine that provides a power output to a hydraulic system. The hydraulic system acts as a power conversion system that includes one or more hydraulic pumps for selectively providing pressurized hydraulic fluid to actuators that are operably coupled to work elements in response to signals provided by operator input devices. The hydraulic system also includes a control valve system that selectively provides pressurized hydraulic fluid to actuators in response to signals provided by operator input devices. The excavator 200 includes a plurality of work elements in the form of a first lift arm structure 230 and a second lift arm structure 330 (not all excavators have a second lift arm structure). In addition, excavator 200, being a work vehicle, includes a pair of tractive elements in the form of left and right track assemblies 240A and 240B, which are disposed on opposing sides of the frame 210.

An operator compartment 250 is defined in part by a cab 252, which is mounted on the frame 210. The cab 252 shown on excavator 200 is an enclosed structure, but other operator compartments need not be enclosed. For example, some excavators have a canopy that provides a roof but is not enclosed A control system, shown as block 260 is provided for controlling the various work elements. Control system 260 includes operator input devices, which interact with the power system 220 to selectively provide power signals to actuators to control work functions on the excavator 200.

Frame 210 includes an upper frame portion or house 211 that is pivotally mounted on a lower frame portion or undercarriage 212 via a swivel joint. The swivel joint includes a bearing, a ring gear, and a slew motor with a pinion gear (not pictured) that engages the ring gear to swivel the machine. The slew motor receives a power signal from the control system 260 to rotate the house 211 with respect to the undercarriage 212. House 211 is capable of unlimited rotation about a swivel axis 214 under power with respect to the undercarriage 212 in response to manipulation of an input device by an operator. Hydraulic conduits are fed through the swivel joint via a hydraulic swivel to provide pressurized hydraulic fluid to the tractive elements and one or more work elements such as lift arm 330 that are operably coupled to the undercarriage 212.

The first lift arm structure 230 is mounted to the house 211 via a swing mount 215. (Some excavators do not have a swing mount of the type described here.) The first lift arm structure 230 is a boom-arm lift arm of the type that is generally employed on excavators although certain features of this lift arm structure may be unique to the lift arm illustrated in FIGS. 2-3. The swing mount 215 includes a frame portion 215A and a lift arm portion 215B that is rotationally mounted to the frame portion 215A at a mounting frame pivot 231A. A swing actuator 233A is coupled to the house 211 and the lift arm portion 215B of the mount. Actuation of the swing actuator 233A causes the lift arm structure 230 to pivot or swing about an axis that extends longitudinally through the mounting frame pivot 231A.

The first lift arm structure 230 includes a first portion, known generally as a boom 232 and a second portion known as an arm or a dipper 234. The boom 232 is pivotally attached on a first end 232A to mount 215 at boom pivot mount 231B. A boom actuator 233B is attached to the mount 215 and the boom 232. Actuation of the boom actuator 233B causes the boom 232 to pivot about the boom pivot mount 231B, which effectively causes a second end 232B of the boom to be raised and lowered with respect to the house 211. A first end 234A of the arm 234 is pivotally attached to the second end 232B of the boom 232 at an arm mount pivot 231C. An arm actuator 233C is attached to the boom 232 and the arm 234. Actuation of the arm actuator 233C causes the arm to pivot about the arm mount pivot 231C. Each of the swing actuator 233A, the boom actuator 233B, and the arm actuator 233C can be independently controlled in response to control signals from operator input devices.

An exemplary implement interface 270 is provided at a second end 234B of the arm 234. The implement interface 270 includes an implement carrier 272 that is capable of accepting and securing a variety of different implements to the lift arm 230. Such implements have a machine interface that is configured to be engaged with the implement carrier 272. The implement carrier 272 is pivotally mounted to the second end 234B of the arm 234. An implement carrier actuator 233D is operably coupled to the arm 234 and a linkage assembly 276. The linkage assembly includes a first link 276A and a second link 276B. The first link 276A is pivotally mounted to the arm 234 and the implement carrier actuator 233D. The second link 276B is pivotally mounted to the implement carrier 272 and the first link 276A. The linkage assembly 276 is provided to allow the implement carrier 272 to pivot about the arm 234 when the implement carrier actuator 233D is actuated.

The implement interface 270 also includes an implement power source (not shown in FIGS. 2-3) available for connection to an implement on the lift arm structure 230. The implement power source includes pressurized hydraulic fluid port to which an implement can be coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The electrical power source can also include electrical conduits that are in communication with a data bus on the excavator 200 to allow communication between a controller on an implement and electronic devices on the excavator 200. It should be noted that the specific implement power source on excavator 200 does not include an electrical power source.

The lower frame 212 supports and has attached to it a pair of tractive elements 240, identified in FIGS. 2-3 as left track drive assembly 240A and right track drive assembly 240B. Each of the tractive elements 240 has a track frame 242 that is coupled to the lower frame 212. The track frame 242 supports and is surrounded by an endless track 244, which rotates under power to propel the excavator 200 over a support surface. Various elements are coupled to or otherwise supported by the track 242 for engaging and supporting the track 244 and cause it to rotate about the track frame. For example, a sprocket 246 is supported by the track frame 242 and engages the endless track 244 to cause the endless track to rotate about the track frame. An idler 245 is held against the track 244 by a tensioner (not shown) to maintain proper tension on the track. The track frame 242 also supports a plurality of rollers 248, which engage the track and, through the track, the support surface to support and distribute the weight of the excavator 200. An upper track guide 249 is provided for providing tension on track 244 and prevent the track from rubbing on track frame 242.

A second, or lower lift arm 330 is pivotally attached to the lower frame 212. A lower lift arm actuator 332 is pivotally coupled to the lower frame 212 at a first end 332A and to the lower lift arm 330 at a second end 332B. The lower lift arm 330 is configured to carry a lower implement 334. The lower implement 334 can be rigidly fixed to the lower lift arm 330 such that it is integral to the lift arm. Alternatively, the lower implement can be pivotally attached to the lower lift arm via an implement interface, which in some embodiments can include an implement carrier of the type described above. Lower lift arms with implement interfaces can accept and secure various different types of implements thereto. Actuation of the lower lift arm actuator 332, in response to operator input, causes the lower lift arm 330 to pivot with respect to the lower frame 212, thereby raising and lowering the lower implement 334.

Upper frame portion 211 supports cab 252, which defines, at least in part, operator compartment or station 250. A seat 254 is provided within cab 252 in which an operator can be seated while operating the excavator. While sitting in the seat 254, an operator will have access to a plurality of operator input devices 256 that the operator can manipulate to control various work functions, such as manipulating the lift arm 230, the lower lift arm 330, the traction system 240, pivoting the house 211, the tractive elements 240, and so forth.

Excavator 200 provides a variety of different operator input devices 256 to control various functions. For example, hydraulic joysticks are provided to control the lift arm 230, and swiveling of the house 211 of the excavator. Foot pedals with attached levers are provided for controlling travel and lift arm swing. Electrical switches are located on the joysticks for controlling the providing of power to an implement attached to the implement carrier 272. Other types of operator inputs that can be used in excavator 200 and other excavators and power machines include, but are not limited to, switches, buttons, knobs, levers, variable sliders and the like. The specific control examples provided above are exemplary in nature and not intended to describe the input devices for all excavators and what they control.

Display devices are provided in the cab to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can be dedicated to provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided.

The description of power machine 100 and excavator 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on an excavator such as excavator 200, unless otherwise noted, the concepts discussed below are not intended to be limited in their application to the environments specifically described above.

FIG. 4 illustrates an excavator 400, which is another particular example of a power machine of the type illustrated in FIG. 1, on which the disclosed embodiments can be employed. Unless specifically noted otherwise, embodiments disclosed below can be practiced on a variety of power machines, with excavator 400 being only one of those power machines. Excavator 400 is described below for illustrative purposes. Not every excavator or power machine on which the illustrative embodiments can be practiced need have all the features or be limited to the features that excavator 400 has. In some exemplary embodiments, excavator 400 includes the various components and features discussed above with reference to excavator 200 shown in FIGS. 2-3. As such, not all of these components are described separately with reference to excavator 400 shown in FIG. 4.

Excavator 400 has a frame 410 that supports various components described above with reference to excavator 200, such as a power system, control systems, etc. Frame 410 includes an upper frame portion or house 411 that is pivotally mounted on a lower frame portion or undercarriage 412 via a swivel joint (not shown). The upper frame portion supports a cab 452 and other components as described above. The excavator 400 includes a plurality of work elements in the form of a first lift arm structure 430 and a second lift arm 530. In addition, excavator 400 includes a pair of tractive elements in the form of left and right track assemblies (represented generally at 440), which are disposed on opposing sides of the frame 410.

An operator compartment is defined at least in part by the cab 452, which is mounted on the frame 410. As was the case with previous embodiments, the cab 452 shown on excavator 400 is an enclosed structure, but other operator compartments need not be enclosed. The control system of power machine 400, which controls the various work elements and includes operator input devices interacting with a power system to selectively provide power signals to actuators to control work functions, is not separately discussed with reference to excavator 400.

Lift arm structure 430 includes a boom or first arm portion 432 and a dipper or second arm portion 434. Boom 432 is pivotally coupled to the frame 410 at pivot joint 417. In other embodiments, additional arm portions or sections can be included between boom 432 and second arm portion 434. A boom actuator 433B is attached to a swing mount 415 at pivot joint 419 that is positioned below the pivot joint 417 (and a top surface 422 of the boom 432) on one end and to the boom 432 at pivot joint 421 at another end. The actuation of the boom actuator 433B causes the boom to pivot upward and downward relative to frame 410 about the pivot joint 417 in a path represented by arrow 437. As boom actuator 433B extends and retracts to raise and lower boom 432, boom actuator 433B pivots about pivot joint 419 (which is on swing mount 415) along a path represented by arrow 435. An arm actuator 433C is coupled between boom 432 and the second arm portion 434, and actuation of actuator 433C causes the second arm portion 434 to rotate relative to boom 432 to position an implement, such as a bucket.

The second or lower lift arm 530 is pivotally attached to the lower frame portion 412. A lower lift arm actuator 532 is pivotally coupled to the lower frame portion 412 and to the lower lift arm 430 and is configured to cause a distal end of the lower lift arm 530 to be raised and lowered relative to the frame. The lower lift arm 530 is configured to carry a lower implement 534, such as a blade implement. As discussed above with reference to excavator 200, the lower implement 534 can be rigidly fixed to the lower lift arm 530, or can be pivotally attached to the lower lift arm via an implement interface.

Figure 5:
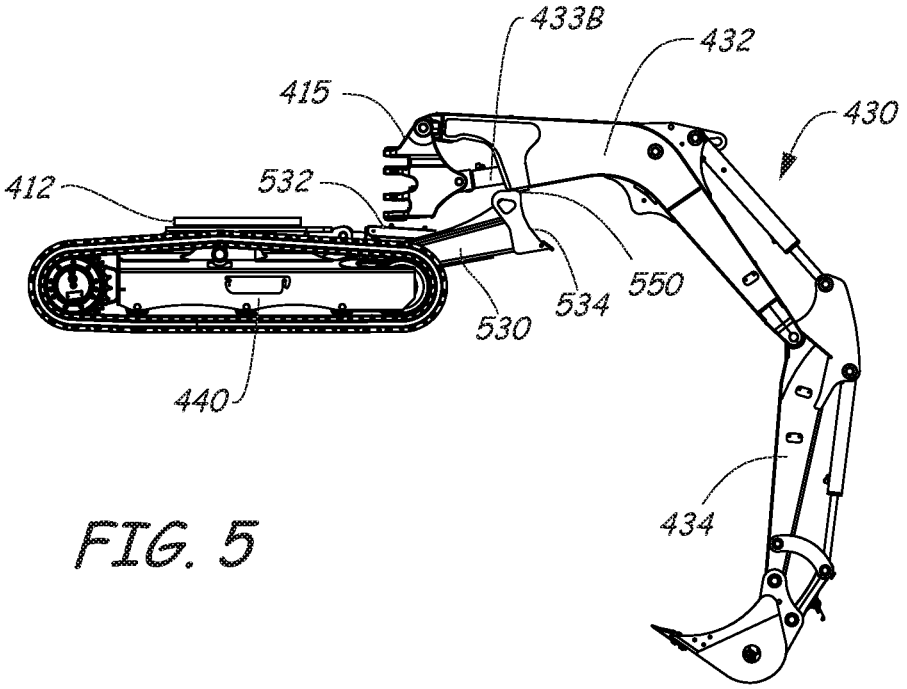
FIG. 5 is a diagrammatic side view illustration of portions of the power machine shown in FIG. 4.
Figure 6:
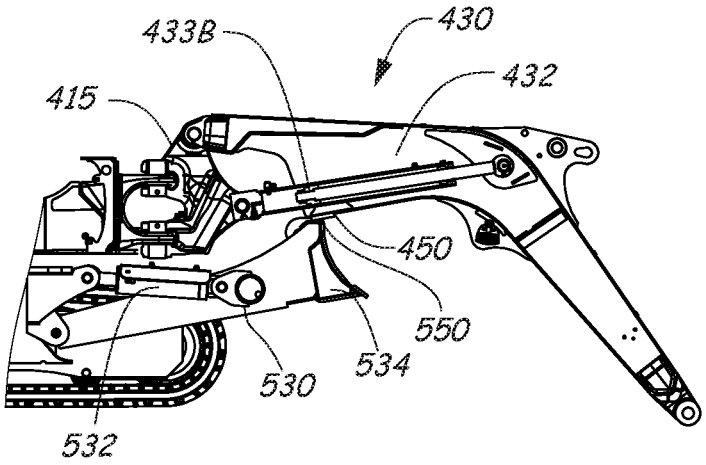
FIG. 6 is another diagrammatic side view illustration of portions of the power machine shown in FIG. 4 and further showing additional features in accordance with some embodiments.

As lower lift arm actuator 532 is controlled to raise lower lift arm 530, and/or as boom actuator 433B is controlled to lower boom 432, a surface of lower implement 534 moves along a path 535 that can cross or intersects with the path 435 of boom actuator 433B, creating the potential for contact between an upper edge or surface 550 of lower implement 534 and boom actuator 433B. To protect boom actuator 433B from damage by such contact, in exemplary embodiments, boom 432 is configured to include a stop or stop portion 450 positioned and oriented to receive any contact between the upward path of upper edge or surface 550 of lower implement 534 and the boom actuator 433B and/or boom 432. FIGS. 5 and 6 illustrate portions of excavator 400, with other portions removed, to show the lower lift arm 530 in a raised position and boom 432 in a lowered position, demonstrating the positioning of stop 450 at a position which intercepts the path of edge or surface 550 to prevent contact between lower implement 534 and actuator 433B.

In some exemplary embodiments, stop 450 is a structure secured to boom 432 at the position which intercepts the path of edge or surface 550 of lower implement 534. However, in other embodiments, stop 450 is integrally formed as part of the boom 432, for example with actuator 433B positioned at least partially interior to portions of the boom. In some embodiments, an extended portion of actuator 433B can be positioned interior to portions of the boom 432 to protect actuator 433B from not only impact with implement 534, but also from impact with handled material, debris or other objects.

Figure 7:
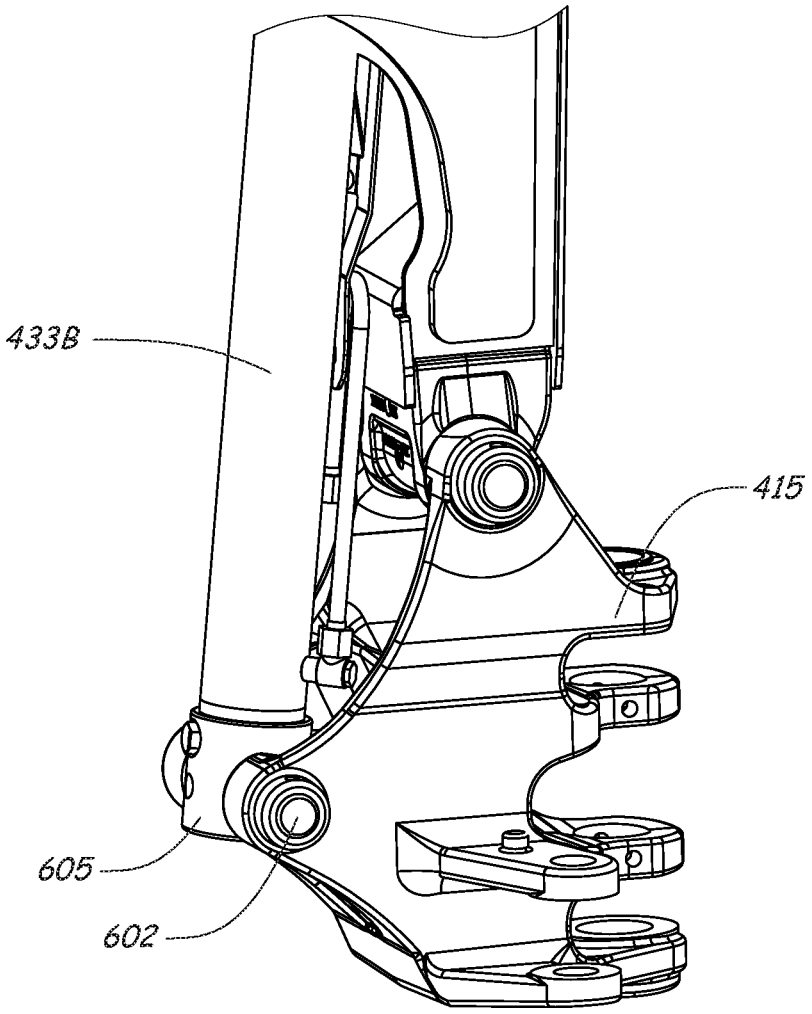
FIG. 7 is a diagrammatic perspective view of portions of a swing mount and boom actuator of the power machine illustrated in FIG. 4 and further showing additional features in accordance with some embodiments.

Referring now to FIG. 7, shown is a diagrammatic perspective view of portions of swing mount 415 and boom actuator 433B, which is pivotally mounted to the swing mount at pivot connection 602. If a hose connecting boom actuator 433B to other hydraulic components or pathways, such as to a control valve or other valves, is damaged, boom 432 can be stuck in a raised position. In some exemplary embodiments, to aid in such circumstances, an override device 605 is included in fluid communication with an end of actuator 433B in order to allow the boom to be lowered. For example, override device 605 can be included in fluid communication with the base end of actuator 433B.

Figure 8:
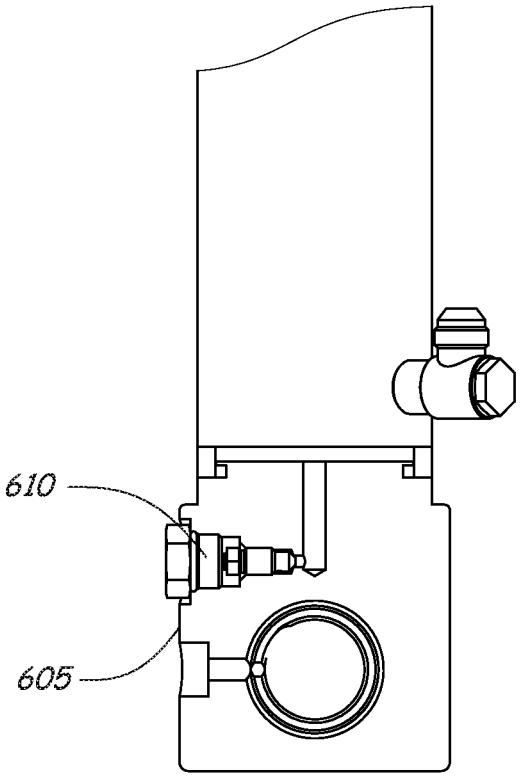
FIG. 8 is a diagrammatic illustration of a portion of the boom cylinder shown in FIG. 7 in accordance with some exemplary embodiments.
Figure 9:
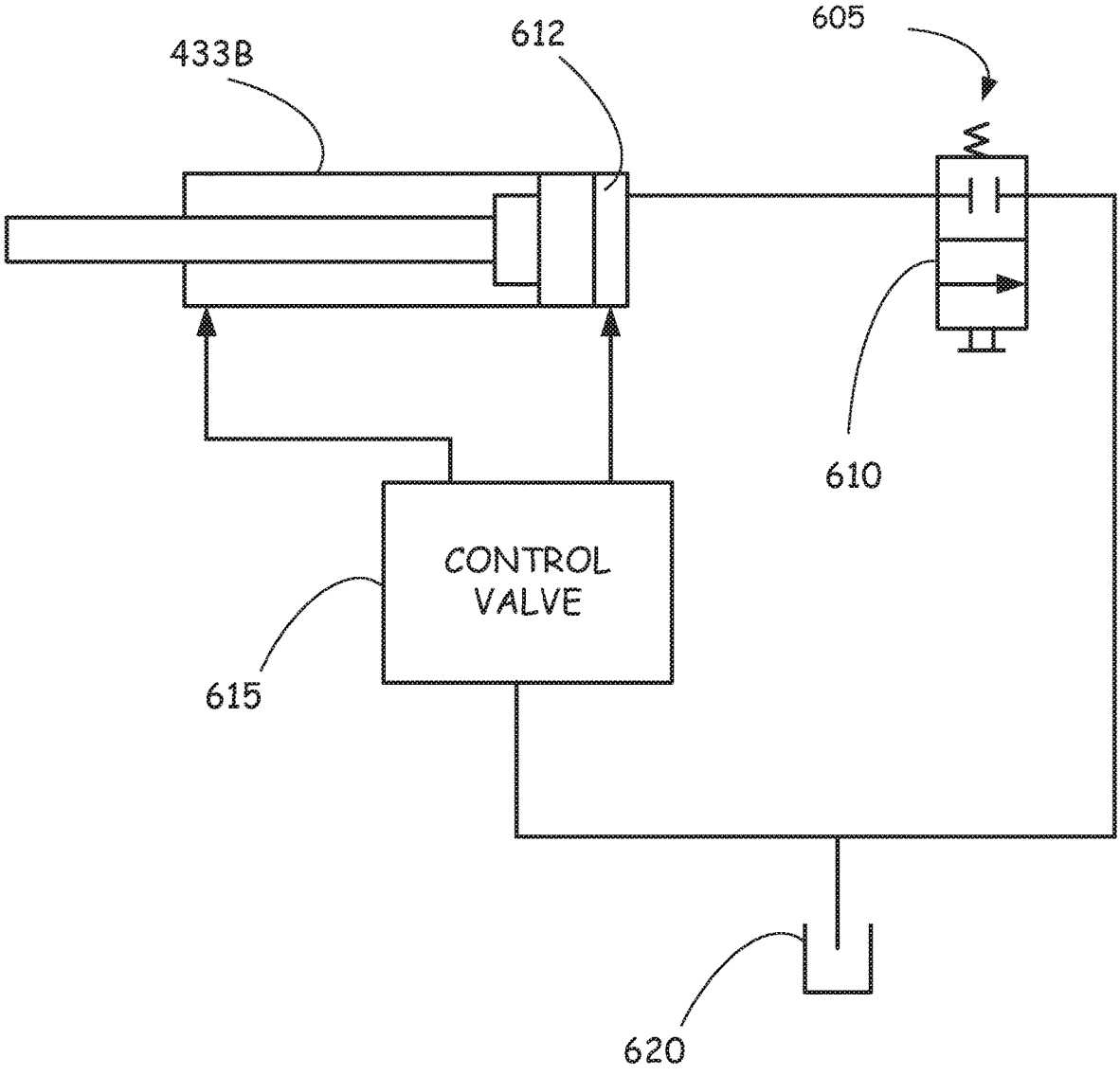
FIG. 9 is a schematic diagram illustrating aspects of the boom cylinder features shown in FIGS. 7 and 8.

Referring to FIGS. 8 and 9, override device 605 can include a manually controlled valve 610 coupling the base end 612 of actuator 433B to tank 620. In a default or unactuated position, valve 610 does not allow flow of hydraulic fluid from the base end 612 through the valve 610. In this default position of valve 610, flow of hydraulic fluid into and out of actuator 433B is controlled normally, using a control valve 615 or other hydraulic components. In the case of an accident or component failure preventing lowing or boom 432 in a normal operating fashion, valve 610 can be actuated, for example using a tool to rotate an actuating mechanism, to allow a controlled flow of hydraulic fluid from the actuator 433B to tank 620 such that boom 432 is slowly lowered. Although not illustrated in FIG. 9, those of skill in the art will understand that other valves, fluid pathways, and hydraulic components can be included between actuator 433B, control valve 615, valve 610 and tank 620.

Although the present invention has been described with reference to preferred embodiments, workers skilled in the art will recognize that changes may be made in form and detail without departing from the scope of the discussion.

What is claimed is:

1. A power machine comprising:

a frame comprising a lower frame portion and an upper frame portion, the upper frame portion rotatably mounted on the lower frame portion and configured to be rotated relative to the lower frame portion;

a first lift arm structure having a boom pivotably coupled to the upper frame portion at a first pivot joint;

a boom actuator pivotally coupled between the boom and the upper frame portion at a second pivot joint and operable to raise and lower the boom relative to the upper frame portion along a first path as the boom actuator raises and lowers the boom, the second pivot joint being positioned lower than the first pivot joint;

a second lift arm pivotably coupled to the lower frame portion;

a lower lift arm actuator coupled between the second lift arm and the lower frame portion and configured to raise and lower the second lift arm relative to the lower frame portion;

an implement mounted to the second lift arm and configured to be raised and lowered with the lower lift arm by the lower lift arm actuator, a surface of the implement moving along a second path as the second lift arm is raised and lowered by the lower lift arm actuator, wherein the first path of the boom and the second path of the surface of the implement can intersect; and a stop positioned and oriented to receive contact between the boom and the surface of the implement as the boom moves along the first path and the surface of the implement moves along the second path to prevent contact between the boom actuator and the implement;

wherein the stop is arranged at a position to intercept the second path of the surface of the implement.

2. The power machine of claim 1, wherein the boom is pivotably coupled to the upper frame portion by a swing mount on the upper frame portion.

3. The power machine of claim 2, wherein the boom actuator is coupled to the upper frame portion at the swing mount.

4. The power machine of claim 1, wherein the implement is a blade.

5. The power machine of claim 1, wherein the stop is secured to the boom.

6. The power machine of claim 1, wherein the stop is integrally formed in the boom.

7. The power machine of claim 1, wherein the boom actuator is at least partially positioned interior to a portion of the boom.

8. The power machine of claim 1, wherein the power machine comprises an excavator.

9. An excavator comprising:

a frame comprising an undercarriage and a house, the house rotatably mounted on the undercarriage and configured to be rotated relative to the undercarriage;

a first lift arm structure having a boom pivotably coupled to the house and a dipper arm pivotably coupled to the boom;

a boom actuator coupled between the boom and the house, the boom actuator being coupled to the house at a position lower than and configured to raise and lower the boom relative to the house, the boom moving along a first path relative to the house as the boom actuator raises and lowers the boom;

an arm actuator coupled between the boom and the dipper arm and configured to cause the dipper arm to rotate relative to the boom;

a lower lift arm pivotably coupled to the undercarriage;

a lower lift arm actuator coupled between the lower lift arm and the undercarriage and configured to raise and lower the lower lift arm relative to the undercarriage;

an implement mounted to the lower lift arm and configured to be raised and lowered with the lower lift arm by the lower lift arm actuator, a surface of the implement moving along a second path as the lower lift arm is raised and lowered by the lower lift arm actuator, wherein the first path of the boom and the second path of the surface of the implement intersect; and a stop positioned and oriented to receive any contact between the boom and the surface of the implement as the boom moves along the first path and the surface of the implement moves along the second path to prevent contact between the boom actuator and the implement;

wherein the stop is integrally formed in the boom at a position that intercepts the second path of the surface of the implement.

10. The excavator of claim 9, and further comprising a swing mount coupling the boom to the house.

11. The excavator of claim 10, wherein the boom actuator is coupled between the boom and the swing mount.

12. The excavator of claim 9, wherein the implement is a blade.

13. The excavator of claim 9, wherein the boom actuator is at least partially positioned interior to a portion of the boom.

14. A power machine comprising:

a frame comprising a lower frame portion and an upper frame portion, the upper frame portion rotatably mounted on the lower frame portion and configured to be rotated relative to the lower frame portion;

a first lift arm structure having a boom pivotably coupled to the upper frame portion at a first pivot joint;

a boom actuator pivotally coupled between the boom and the upper frame portion at a second pivot joint and operable to raise and lower the boom relative to the upper frame portion along a first path as the boom actuator raises and lowers the boom, the second pivot joint being positioned lower than the first pivot joint;

a second lift arm pivotably coupled to the lower frame portion;

a lower lift arm actuator coupled between the second lift arm and the lower frame portion and configured to raise and lower the second lift arm relative to the lower frame portion;

an implement mounted to the second lift arm and configured to be raised and lowered with the lower lift arm by the lower lift arm actuator, a surface of the implement moving along a second path as the second lift arm is raised and lowered by the lower lift arm actuator, wherein the first path of the boom and the second path of the surface of the implement can intersect; and a stop positioned and oriented to receive contact between the boom and the surface of the implement as the boom moves along the first path and the surface of the implement moves along the second path to prevent contact between the boom actuator and the implement;

wherein the boom actuator is at least partially positioned interior to a portion of the boom.

* * * * *